US010364546B2

(12) United States Patent
Shimano et al.

(10) Patent No.: US 10,364,546 B2
(45) Date of Patent: Jul. 30, 2019

(54) CONTROL SYSTEM FOR WORK VEHICLE, CONTROL METHOD, AND WORK VEHICLE

(71) Applicant: KOMATSU LTD., Tokyo (JP)

(72) Inventors: Yuki Shimano, Suita (JP); Tomohiro Nakagawa, Hirakata (JP); Masashi Ichihara, Hiratsuka (JP); Jin Kitajima, Ohiso-machi (JP)

(73) Assignee: KOMATSU LTD., Tokyo (JP)

( * ) Notice: Subject to any disclaimer, the term of this patent is extended or adjusted under 35 U.S.C. 154(b) by 309 days.

(21) Appl. No.: 15/118,238

(22) PCT Filed: Mar. 17, 2016

(86) PCT No.: PCT/JP2016/058573

§ 371 (c)(1),
(2) Date: Aug. 11, 2016

(87) PCT Pub. No.: WO2016/133225

PCT Pub. Date: Aug. 25, 2016

(65) Prior Publication Data

US 2017/0268198 A1 Sep. 21, 2017

(51) Int. Cl.
*E02F 3/43* (2006.01)
*E02F 3/96* (2006.01)
(Continued)

(52) U.S. Cl.
CPC ..... *E02F 3/435* (2013.01); *E02F 3/32* (2013.01); *E02F 3/967* (2013.01); *E02F 9/2033* (2013.01);
(Continued)

(58) Field of Classification Search
CPC ..... E02F 3/435; E02F 3/841; E02F 9/2029; E02F 9/2203; E02F 3/967; E02F 9/2033
(Continued)

(56) References Cited

U.S. PATENT DOCUMENTS

2011/0318155 A1* 12/2011 Okamura ..... E02F 9/2203 414/685
2016/0069040 A1 3/2016 Kami et al.
2016/0097184 A1 4/2016 Matsuyama et al.

FOREIGN PATENT DOCUMENTS

CN 103890273 A 6/2014
JP 2007-85093 A 4/2007
(Continued)

OTHER PUBLICATIONS

International Search Report for the corresponding international application No. PCT/JP2016/058573, dated Jun. 14, 2016.
(Continued)

*Primary Examiner* — Isaac G Smith
(74) *Attorney, Agent, or Firm* — Global IP Counselors, LLP

(57) ABSTRACT

A distance obtaining unit obtains the distance between a work implement and a design terrain. A work aspect determining unit determines a work aspect by the work implement. A limit velocity deciding unit limits the velocity of the work implement when the distance between the work implement and the design terrain becomes smaller. When the work aspect is surface compaction work and the distance between the work implement and the design terrain is within a first range of at least a portion that is equal to or less than a predetermined first distance, the limit velocity deciding unit increases the limit velocity of the work implement in comparison to when the work aspect is an aspect of a work other than surface compaction, or cancels the limiting of the velocity of the work implement.

11 Claims, 12 Drawing Sheets

(51) Int. Cl.

| | |
|---|---|
| ***E02F 9/22*** | (2006.01) |
| ***E02F 9/26*** | (2006.01) |
| ***E02F 9/20*** | (2006.01) |
| ***E02F 3/32*** | (2006.01) |

(52) U.S. Cl.
CPC ..... *E02F 9/2203* (2013.01); *E02F 9/262* (2013.01); *E02F 9/265* (2013.01)

(58) Field of Classification Search
USPC ..... 701/50
See application file for complete search history.

(56) References Cited

FOREIGN PATENT DOCUMENTS

| | | | | | |
|---|---|---|---|---|---|
| JP | 2007085093 | A | * | 4/2007 | |
| JP | 2010-209523 | A | | 9/2010 | |
| JP | 5791827 | B | | 10/2015 | |
| WO | 2015/025987 | A1 | | 2/2015 | |
| WO | WO-2015025989 | A1 | * | 2/2015 | ..... E02F 3/435 |

OTHER PUBLICATIONS

The Office Action for the corresponding Korean application No. 10-2016-7020913, dated May 30, 2017.
The Office Action for the corresponding Chinese application No. 201680000616.6, dated Sep. 5, 2018.

* cited by examiner

CONTROL SYSTEM FOR WORK VEHICLE, CONTROL METHOD, AND WORK VEHICLE

CROSS-REFERENCE TO RELATED APPLICATIONS

This application is a U.S. National stage application of International Application No. PCT/JP2016/058573, filed on Mar. 17, 2016.

BACKGROUND

Field of the Invention

The present invention relates to a control system for a work vehicle, a control method, and a work vehicle.

Background Information

Conventionally, a control (referred to below as "velocity limit control") is performed for limiting the velocity of a work implement toward a design terrain in correspondence to a decrease in the distance between the work implement and the design terrain in a control system in a work vehicle. The design terrain is a target shape to be excavated.

For example, the upper limit of the velocity of a work implement toward the design terrain in the control system in the work vehicle described in Japanese Patent No. 5791827 is reduced in correspondence to a reduction in the distance between the work implement and the design terrain. When the distance between the work implement and the design terrain reaches zero, the velocity of the work implement is controlled to become zero. As a result, the work implement exceeding the design terrain and excavating can be restricted.

SUMMARY

A work vehicle performs surface compaction by a work implement on the ground surface to be leveled. Surface compaction involves moving the work implement toward the ground surface and striking the ground surface whereby the ground surface becomes compacted. In this case, the leveled surface is near the abovementioned design terrain. Therefore, when the above-mentioned velocity limit control is in operation during surface compaction work, the work implement suddenly decelerates before striking the ground. As a result it is difficult to carry out surface compaction work properly.

An object of the present invention is to provide a control system and a control method for a work vehicle, and a work vehicle that enable favorable surface compaction work.

A control system for a work vehicle according to a first aspect of the present invention includes a storage unit, a distance obtaining unit, a work aspect determining unit, and a limit velocity deciding unit. The storage unit stores construction information. The construction information defines a design terrain which represents a target shape of a work object. The distance obtaining unit obtains the distance between the work implement and the design terrain. The work aspect determining unit determines a work aspect by the work implement. The limit velocity deciding unit limits the velocity of the work implement when the distance between the work implement and the design terrain becomes smaller. When the work aspect is surface compaction work and the distance between the work implement and the design terrain is within a first range, the limit velocity deciding unit executes a surface compaction control in which the limit velocity deciding unit increases the limit velocity of the work implement in comparison to when the work aspect is an aspect of a work other than surface compaction, or cancels the limiting of the velocity of the work implement. The first range is a range of at least a portion equal to or less than a predetermined first distance.

The limit velocity deciding unit in the control system for the work vehicle according to the present aspect limits the velocity of the work implement when the distance between the work implement and the design terrain becomes smaller. As a result, the work implement exceeding the design terrain and excavating can be restricted during excavation. Moreover, when the work aspect is surface compaction work and the distance between the work implement and the design terrain is within the first range, the limit velocity deciding unit increases the limit velocity of the work implement in comparison to when the work aspect is an aspect of a work other than surface compaction, or cancels the limit of the velocity of the work implement. As a result, the work implement is able to strike the ground during surface compaction work at a velocity greater than that during excavation work. As a result, the surface compaction work can be carried out in a favorable manner.

When the work aspect is the surface compaction work and the distance between the work implement and the design terrain is within a range from the first distance to a second distance that is smaller than the first distance, the limit velocity deciding unit may make the limit velocity constant even when the distance becomes smaller. In this case, the limiting of the velocity of the work implement is relaxed while the distance in within the first range.

When the work aspect is the surface compaction work and the distance between the work implement and the design terrain is within a range from the second distance to a third distance that is smaller than the second distance, the limit velocity deciding unit may reduce the limit velocity in correspondence to a reduction in the distance. In this case, the velocity of the work implement can be limited as the work implement approaches the ground surface. As a result, the work implement striking the ground surface with an excessively large velocity can be restricted. As a result, excessive impacts can be suppressed.

When the distance between the work implement and the design terrain is within a second range, the limit velocity when the work aspect is the surface compaction work may be the same as the limit velocity when the work aspect is a work other than the surface compaction. The second range is a range from the lower limit of the first range to zero. In this case, the work implement can be operated in the same way as when carrying out a work other than surface compaction when the work implement is in the proximity of the ground surface even when the work is determined as still being surface compaction work after the surface compaction has been completed. As a result, the cutting edge of the work implement can be manipulated easily to conform to the design terrain for example.

The first range may be wider than the second range. In this case, the velocity of the work implement can be sufficiently increased while the distance between the work implement and the design terrain is within the first range. As a result, the surface compaction work can be carried out in a favorable manner.

The limit velocity may be zero when the distance between the work implement and the design terrain is zero and the work aspect is the surface compaction work. In this case, the work implement exceeding and excavating the design terrain during the surface compaction work can be restricted.

The control system may further include an operating member of the work implement. When a determination condition of the surface compaction work is satisfied, the work aspect determining unit may determine that the work aspect is the surface compaction work. The determination condition of the surface compaction work may include a ratio of the operation amount of the operating member subjected to a low-pass filter treatment with respect to the actual operation amount of the operating member, being smaller than a predetermined threshold. In this case, the work aspect can be determined as the surface compaction work with greater accuracy.

The storage unit may store first limit velocity information and second limit velocity information. The first limit velocity information may represent a relationship between the distance and the limit velocity when the work aspect is the surface compaction work. The second limit velocity information may represent a relationship between the distance and the limit velocity when the work aspect is a work other than the surface compaction work. The limit velocity deciding unit may decide the limit velocity on the basis of the first limit velocity information when the work aspect is the surface compaction work. The limit velocity deciding unit may decide the limit velocity on the basis of the second limit velocity information when the work aspect is a work other than the surface compaction work. The limit velocity when the distance is within the first range according to the first limit velocity information may be greater than the limit velocity when the distance is within the first range according to the second limit velocity information.

The work aspect determining unit may determine whether a leveling determination condition for determining that the work by the work implement is leveling work is satisfied. The limit velocity deciding unit may decide to execute a leveling control for controlling the work implement so that the work implement moves along the design terrain when the leveling determination condition is satisfied. The limit velocity deciding unit may maintain the surface compaction control when the leveling work condition is satisfied while the surface compaction control is being executed.

In this case, the leveling control is carried out when the leveling determination condition is satisfied. As a result, the leveling work can be carried out in a favorable manner. Moreover, the surface compaction work is maintained even when the leveling control condition is satisfied while the surface compaction control is being carried out. As a result, the leveling control being carried out by mistaken during the surface compaction work can be suppressed. As a result, the leveling work and the surface compaction work can be carried out in a favorable manner.

A control method for the work vehicle according to a second aspect of the present invention includes the following steps. In the first step, distance information is obtained. The distance information indicates the distance between the work implement and the design terrain which represents a target shape of a work object. In the second step, the work aspect by the work implement is determined. In the third step, a command signal is output so as to limit the velocity of the work implement in response to a reduction in the distance when the work aspect is a work other than surface compaction. In the fourth step, the command signal is output so that the limit velocity of the work implement is increased in comparison to when the work aspect is an aspect of a work other than surface compaction, or to cancel the limiting of the velocity of the work implement when the work aspect is the surface compaction work and the distance is within at least a predetermined first range.

In the control method of the work vehicle according to the present aspect, the velocity of the work implement is limited in response to a reduction in the distance between the work implement and the design terrain. As a result, the work implement exceeding the design terrain and excavating can be restricted during excavation. Moreover, when the work aspect is the surface compaction work and the distance between the work implement and the design terrain is within at least the predetermined first range, the limit velocity of the work implement is increased in comparison to when the work aspect is an aspect of a work other than surface compaction, or the limit of the velocity of the work implement is canceled. As a result, the work implement is able to strike the ground during surface compaction work at a velocity greater than during excavation work. As a result, the surface compaction work can be carried out in a favorable manner.

A work vehicle according to a third aspect of the present invention includes a work implement and a work implement control unit. The work implement control unit controls the work implement. The work implement control unit controls the work implement so that the velocity of the work implement becomes smaller when the distance between the work implement and a design terrain which represents a target shape of a work object becomes smaller. The work implement control unit controls the work implement so that the velocity of the work implement increases in comparison to when the work aspect is a work other than surface compaction when the work aspect is the surface compaction work and the distance is within a first range. The first range is a range of at least a portion equal to or less than a predetermined first distance.

The velocity of the work implement is reduced when the distance between the work implement and the design terrain becomes smaller in the work vehicle according to the present aspect. As a result, the work implement exceeding the design terrain and excavating can be suppressed during excavation. Moreover, when the work aspect is the surface compaction work and the distance between the work implement and the design terrain is within a first range, the velocity of the work implement is increased in comparison to when the work aspect is a work other than surface compaction. As a result, the work implement is able to strike the ground during surface compaction work at a velocity greater than during excavation work. As a result, the surface compaction work can be carried out in a favorable manner.

According to the present invention, surface compaction work can be carried out in a favorable manner by a work vehicle.

DESCRIPTION OF EXEMPLARY EMBODIMENTS

Figure 1:
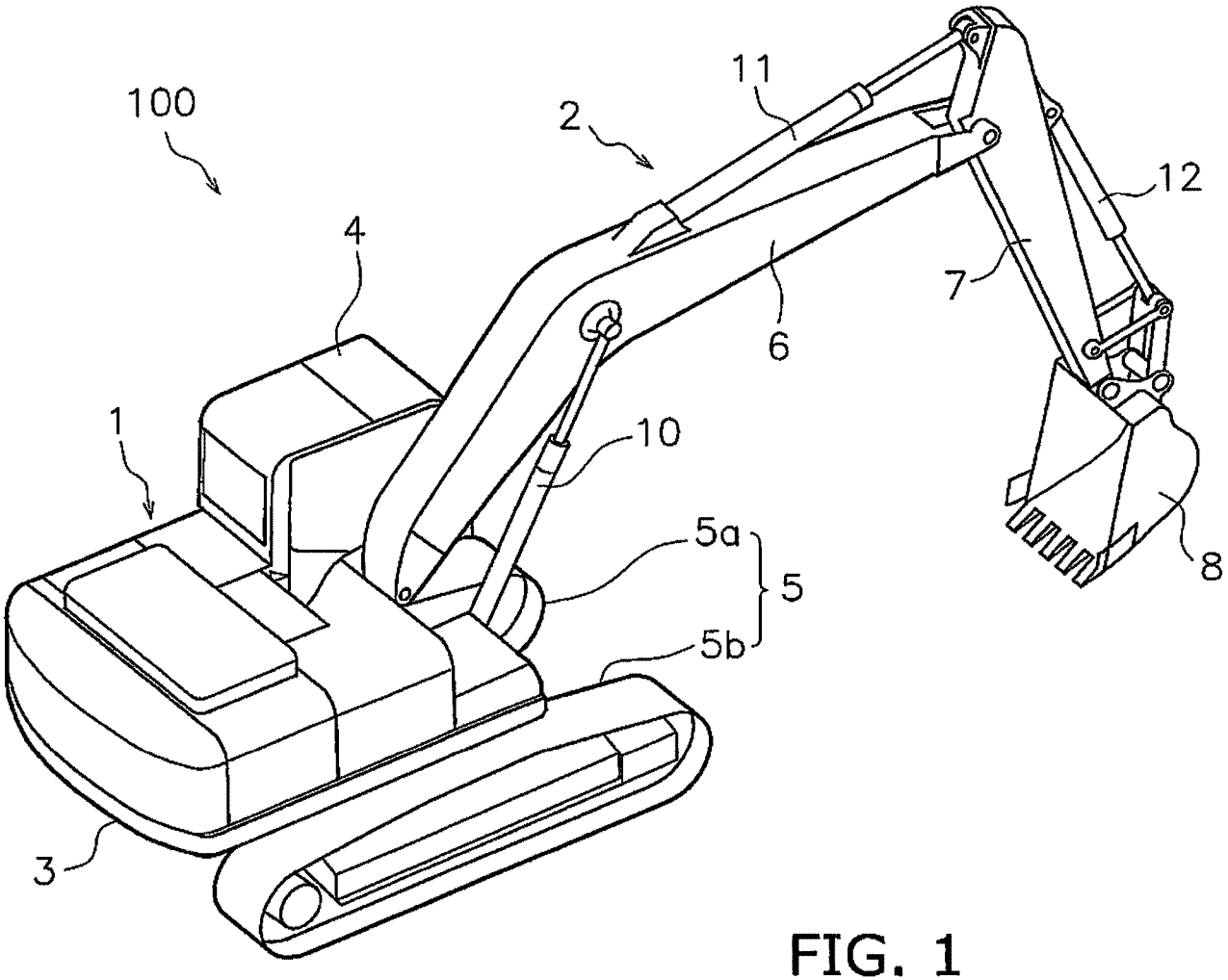
FIG. 1 is a perspective view of a work vehicle according to an exemplary embodiment.

Hereinbelow, a first exemplary embodiment of the present invention will be described with reference to the accompanying drawings. FIG. 1 is a perspective view of a work vehicle 100 according to the first exemplary embodiment. The work vehicle 100 is a hydraulic excavator according to the present exemplary embodiment. The work vehicle 100 is provided with a vehicle body 1 and a work implement 2.

The vehicle body 1 has a revolving body 3 and a travel device 5. The revolving body 3 contains devices such as an engine and a hydraulic pump described below. An operating cabin 4 is provided in the revolving body 3. The travel device 5 has crawler belts 5*a* and 5*b*, and the work vehicle 100 travels due to the rotation of the crawler belts 5*a* and 5*b*.

The work implement 2 is attached to the vehicle body 1. The work implement 2 has a boom 6, an arm 7, and a bucket 8. The proximal end portion of the boom 6 is attached to the front portion of the vehicle body 1 in an operable manner. The proximal end portion of the arm 7 is attached to the distal end portion of the boom 6 in an operable manner. The bucket 8 is attached in an operable manner to the distal end portion of the arm 7.

The work implement 2 includes a boom cylinder 10, and arm cylinder 11, and a bucket cylinder 12. The boom cylinder 10, the arm cylinder 11, and the bucket cylinder 12 are hydraulic cylinders that are driven by hydraulic fluid. The boom cylinder 10 drives the boom 6. The arm cylinder 11 drives the arm 7. The bucket cylinder 12 drives the bucket 8.

Figure 2:
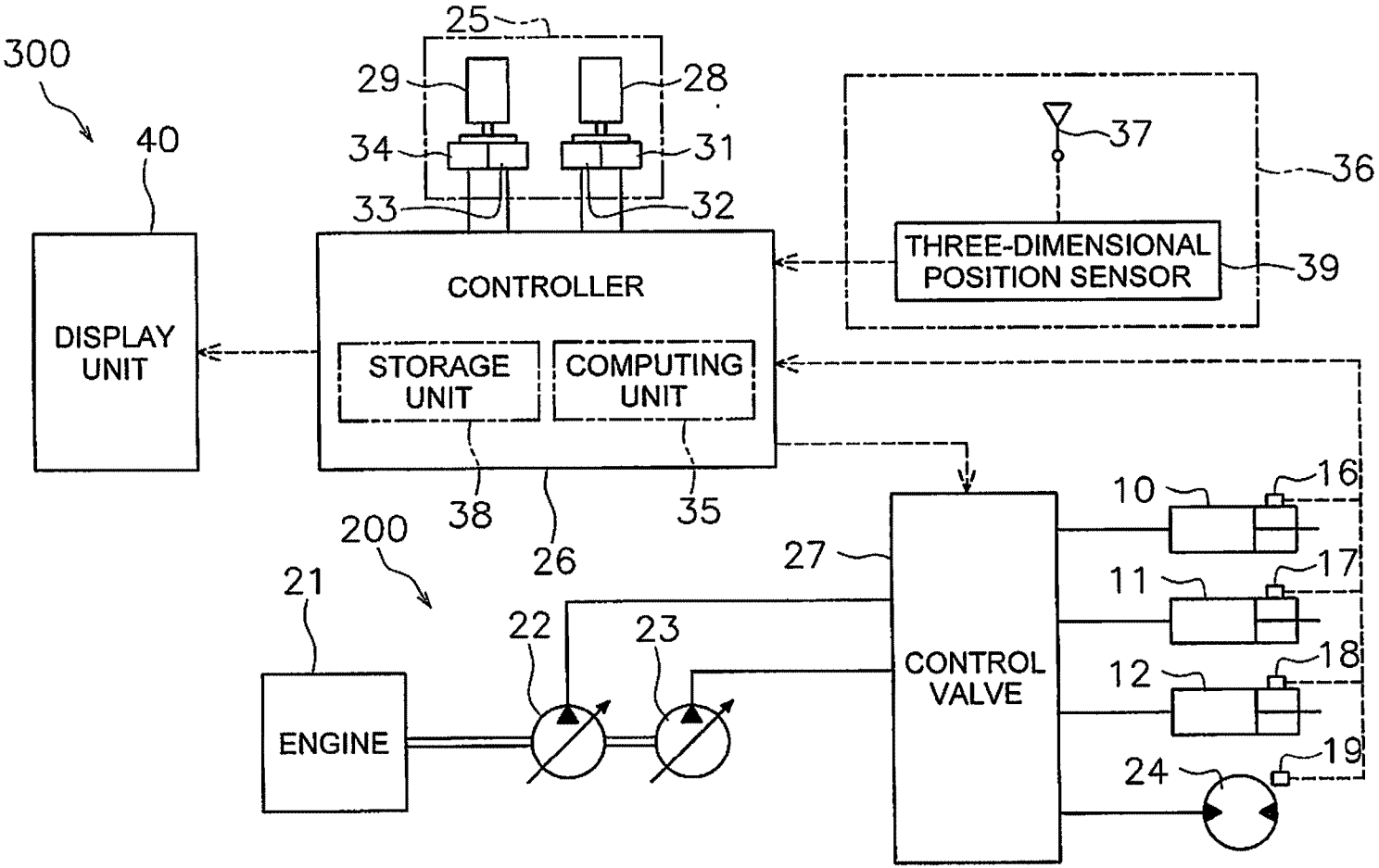
FIG. 2 is a block diagram illustrating a configuration of a control system in the work vehicle.

FIG. 2 is a block diagram illustrating a configuration of a control system 300 and a drive system 200 provided in the work vehicle 100. As illustrated in FIG. 2, the drive system 200 is provided with an engine 21 and hydraulic pumps 22 and 23.

The hydraulic pumps 22 and 23 are driven by the engine 21 to discharge hydraulic fluid. The boom cylinder 10, the arm cylinder 11, and the bucket cylinder 12 are supplied with hydraulic fluid discharged from the hydraulic pumps 22 and 23. The work vehicle 100 is also provided with a revolution motor 24. The revolution motor 24 is a hydraulic motor and is driven by hydraulic fluid discharged from the hydraulic pumps 22 and 23. The revolution motor 24 rotates the revolving body 3.

While two hydraulic pumps 22 and 23 are illustrated in FIG. 2, only one hydraulic pump may be provided. The revolution motor 24 is not limited to a hydraulic motor and may be an electric motor.

The control system 300 is provided with an operating device 25, a controller 26, and a control valve 27. The operating device 25 is a device for operating the work implement 2. The operating device 25 receives operations from an operator for driving the work implement 2 and outputs an operation signal in accordance with an operation amount. The operating device 25 has a first operating member 28 and a second operating member 29.

The first operating member 28 is, for example, an operation lever. The first operating member 28 is provided in a manner that allows operation in the four directions of front, back, left, and right. Two of the four operating directions of the first operating member 28 are assigned to a raising operation and a lowering operation of the boom 6. The remaining two operating directions of the first operating member 28 are assigned to a raising operation and a lowering operation of the bucket 8.

The second operating member 29 is, for example, an operation lever. The second operating member 29 is provided in a manner that allows operation in the four directions of front, back, left, and right. Two of the four operating directions of the second operating member 29 are assigned to a raising operation and a lowering operation of the arm 7. The remaining two operating directions of the second operating member 29 are assigned to a right revolving operation and a left revolving operation of the revolving body 3.

The contents of the operations assigned to the first operating member 28 and the second operating member 29 are not limited as described above and may be modified.

The operating device 25 has a boom operating portion 31 and a bucket operating portion 32. The boom operating portion 31 outputs a boom operation signal in accordance with an operation amount of the first operating member 28 (hereinbelow referred to as "boom operation amount") for operating the boom 6. The boom operation signal is input to the controller 26. The bucket operating portion 32 outputs a bucket operation signal in accordance with an operation amount of the first operating member 28 (hereinbelow referred to as "bucket operation amount") for operating the bucket 8. The bucket operation signal is input to the controller 26.

The operating device 25 has an arm operating portion 33 and a revolving operating portion 34. The arm operating portion 33 outputs arm operation signals in accordance with the operation amount of the second operating member 29 for operating the arm 7 (hereinbelow referred to as "arm operation amount"). The arm operation signals are input to the controller 26. The revolving operating portion 34 outputs revolving operation signals in accordance with an operation amount of the second operating member 29 for operating the revolution of the revolving body 3. The revolving operation signals are input to the controller 26.

The controller 26 is programmed to control the work vehicle 100 on the basis of obtained information. The controller 26 has a storage unit 38 and a computing unit 35. The storage unit 38 is configured by a memory, such as a RAM or a ROM, for example, and an auxiliary storage device. The computing unit 35 is configured by a processing device, such as a CPU, for example. The controller 26 obtains the boom operation signals, the arm operation signals, the bucket operation signals, and the revolution operation signals from the operating device 25. The controller 26 controls the control valve 27 on the basis of the operation signals.

The control valve 27 is an electromagnetic proportional control valve and is controlled by command signals from the controller 26. The control valve 27 is disposed between the hydraulic pumps 22 and 23 and hydraulic actuators such as the boom cylinder 10, the arm cylinder 11, the bucket cylinder 12, and the revolution motor 24. The control valve 27 controls the flow rate of the hydraulic fluid supplied from the hydraulic pumps 22 and 23 to the boom cylinder 10, the arm cylinder 11, the bucket cylinder 12, and the revolution motor 24. The controller 26 controls command signals to the control valve 27 so that the work implement 2 operates at a velocity in accordance with the operation amounts of each of the above-mentioned operating members. As a result, the outputs of the boom cylinder 10, the arm cylinder 11, the bucket cylinder 12, and the revolution motor 24 are controlled in response to the operation amounts of the respective operating members.

The control valve 27 may be a pressure proportional control valve. In such a case, pilot pressures in accordance with the operation amounts of the respective operating members are outputted from the boom operating portion 31, the bucket operating portion 32, the arm operating portion 33, and the revolving operating portion 34 and inputted to the control valve 27. The control valve 27 controls the flow rate of the hydraulic fluid supplied to the boom cylinder 10, the arm cylinder 11, the bucket cylinder 12, and the revolution motor 24 in response to the inputted pilot pressures.

The control system 300 has a first stroke sensor 16, a second stroke sensor 17, and a third stroke sensor 18. The first stroke sensor 16 detects a stroke length of the boom cylinder 10 (hereinbelow referred to as "boom cylinder length"). The second stroke sensor 17 detects a stroke length of the arm cylinder 11 (hereinbelow referred to as "arm cylinder length"). The third stroke sensor 18 detects a stroke length of the bucket cylinder 12 (hereinbelow referred to as "bucket cylinder length"). Angle sensors may also be used for measuring the stroke.

The control system 300 is provided with a slope angle sensor 19. The slope angle sensor 19 is arranged in the revolving body 3. The slope angle sensor 19 detects the angle (pitch angle) relative to horizontal in the vehicle front-back direction of the revolving body 3 and the angle (roll angle) relative to horizontal in the vehicle lateral direction.

The sensors 16 to 19 send detection signals to the controller 26. The revolution angle may also be obtained from position information of a below-mentioned GNSS antenna 37. The controller 26 determines the attitude of the work implement 2 on the basis of the detection signals from the sensors 16 to 19.

The control system 300 is provided with a position detecting unit 36. The position detecting unit 36 detects the current position of the work vehicle 100. The position detecting unit 36 has the GNSS antenna 37 and a three-dimensional position sensor 39. The GNSS antenna 37 is provided on the revolving body 3. The GNSS antenna 37 is an antenna for a real-time kinematic-global navigation satellite system (RTK-GNSS). Signals according to GNSS radio waves received by the GNSS antenna 37 are input into the three-dimensional position sensor 39.

Figure 3:
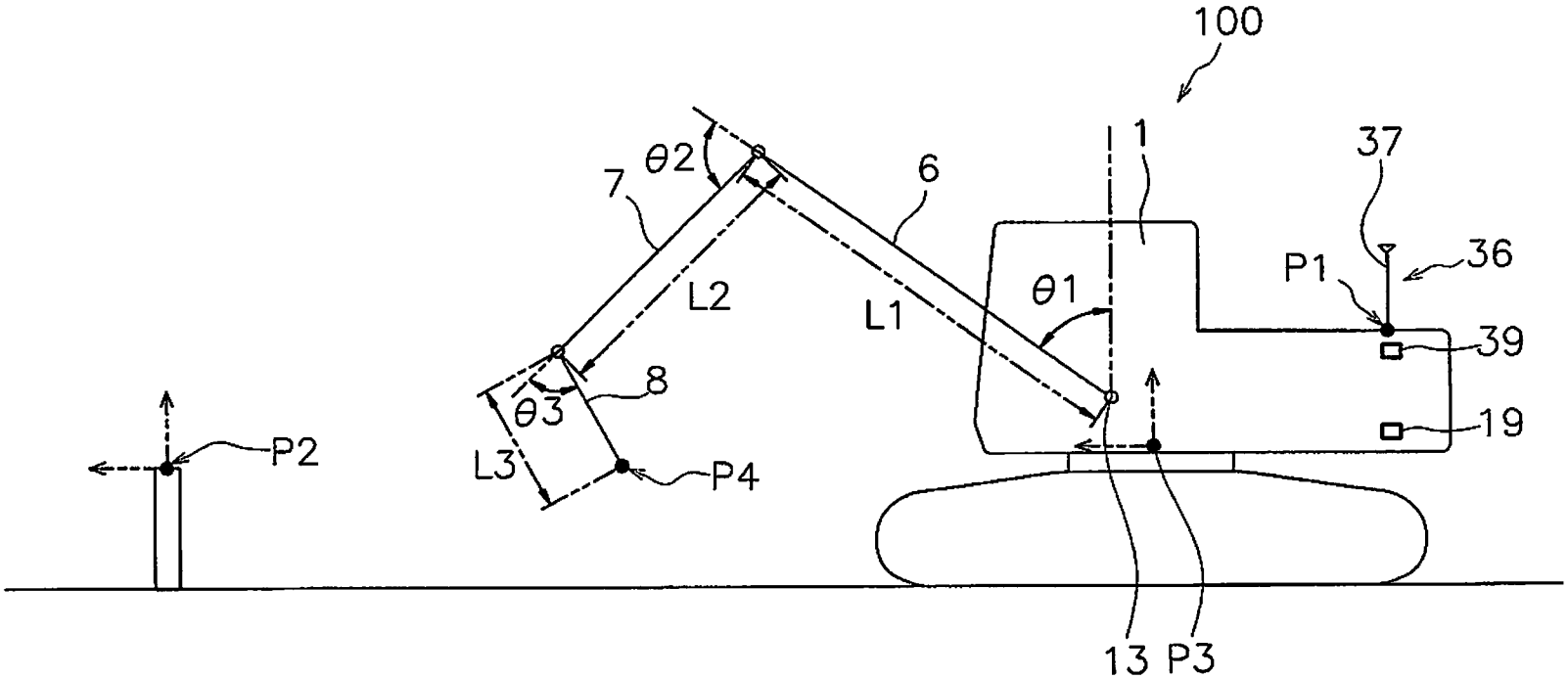
FIG. 3 is a side view schematically illustrating a configuration of the work vehicle.

FIG. 3 is a side view schematically illustrating a configuration of the work vehicle 100. The three-dimensional position sensor 39 detects an installation position P1 of the GNSS antenna 37 in a global coordinate system. The global coordinate system is a three-dimensional coordinate system based on a reference position P2 installed in a work area. As illustrated in FIG. 3, the reference position P2 is, for example, a position at the distal end of a reference marker set in the work area. The controller 26 computes the position of a cutting edge P4 of the work implement 2 as seen in the global coordinate system on the basis of the detection results from the position detecting unit 36 and the attitude of the work implement 2. The cutting edge P4 of the work implement 2 may be expressed as the cutting edge P4 of the bucket 8.

The controller 26 calculates a slope angle θ1 of the boom 6 with respect to the vertical direction in the local coordinate system from the boom cylinder length detected by the first stroke sensor 16. The controller 26 calculates a slope angle θ2 of the arm 7 with respect to the boom 6 from the arm cylinder length detected by the second stroke sensor 17. The controller 26 calculates a slope angle θ3 of the bucket 8 with respect to the arm 7 from the bucket cylinder length detected by the third stroke sensor 18.

The storage unit 38 in the controller 26 stores work implement data. The work implement data includes a length L1 of the boom 6, a length L2 of the arm 7, and a length L3 of the bucket 8. The work implement data includes position information of a boom pin 13 with respect to a reference position P3 in a local coordinate system. The local coordinate system is a three-dimensional system based on the work vehicle 100. The reference position P3 in the local coordinate system is a position at the center of rotation of the revolving body 3.

The controller 26 calculates the position of the cutting edge P4 in the local coordinate system from the slope angle θ1 of the boom 6, the slope angle θ2 of the arm 7, the slope angle θ3 of the bucket 8, the length L1 of the boom 6, the length L2 of the arm 7, the length L3 of the bucket 8, and the position information of the boom pin 13.

The work implement data includes position information of the installation position P1 of the GNSS antenna 37 with respect to the reference position P3 in the local coordinate system. The controller 26 converts the position of the cutting edge P4 in the local coordinate system to the position of the cutting edge P4 in the global coordinate system based on the detection results of the position detecting unit 36 and the position information of the GNSS antenna 37. As a result, the controller 26 obtains the position information of the cutting edge P4 as seen in the global coordinate system.

The storage unit 38 in the controller 26 stores construction information indicating positions and shapes of a three-dimensional design terrain inside the work area. The controller 26 displays the design terrain on a display unit 40 on the basis of the design terrain and the detection results from the above-mentioned sensors. The display unit 40 is, for example, a monitor and displays various types of information of the work vehicle 100.

Figure 4:
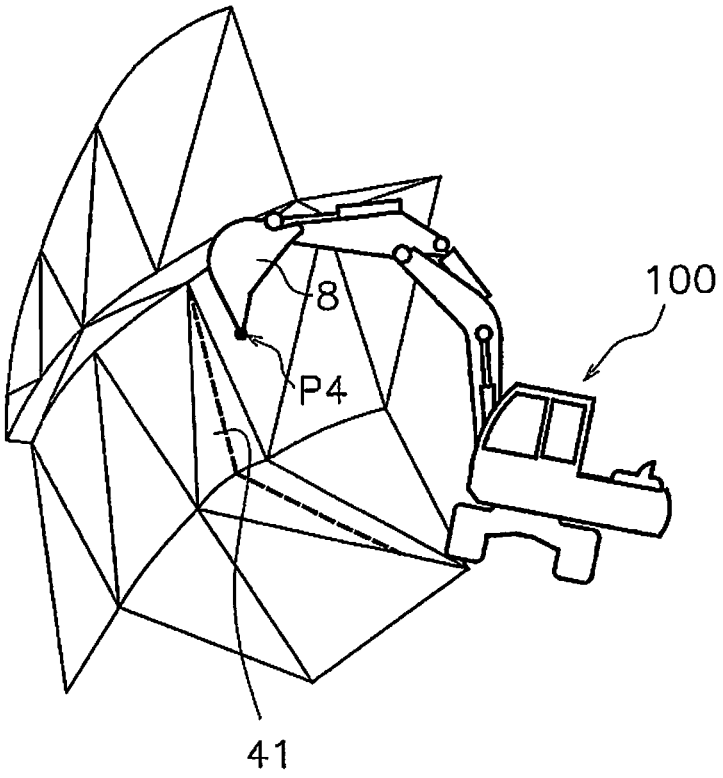
FIG. 4 is a schematic view of an example of a design terrain.

FIG. 4 is a schematic view of an example of a design terrain. As illustrated in FIG. 4, the design terrain is configured by a plurality of design planes 41 that are each represented by polygons. The plurality of design planes 41 represent a target shape to be excavated by the work implement 2. Only one of the plurality of design planes 41 is provided with the reference numeral 41 in FIG. 4, and reference numerals for the other design planes 41 are omitted.

The controller 26 performs velocity limit control by limiting the velocity of the work implement 2 toward the design planes in order to prevent the bucket 8 from penetrating the design plane 41. The velocity limit control performed by the controller 26 is described in detail below.

Figure 5:
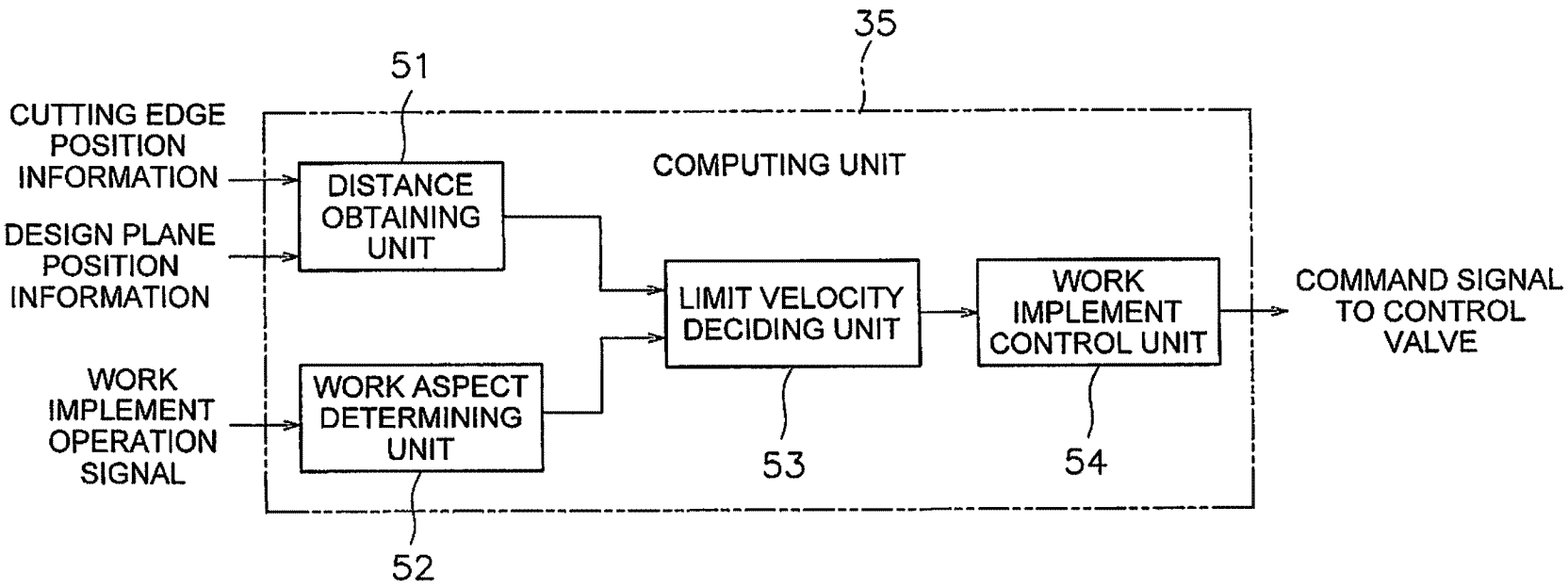
FIG. 5 is a block diagram of a configuration of a controller.
Figure 6:
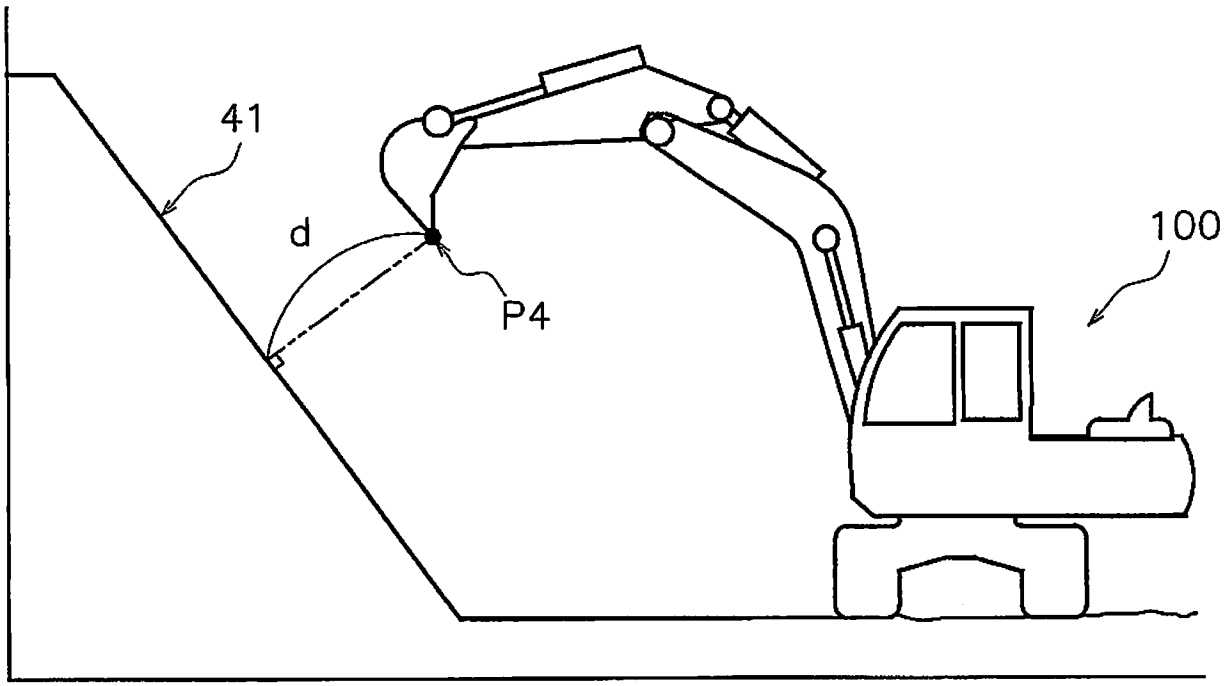
FIG. 6 is a schematic view illustrating the distance between a work implement and the design terrain.

FIG. 5 is a block diagram of a configuration of the controller 26. The computing unit 35 of the controller 26 has a distance obtaining unit 51, a work aspect determining unit 52, a limit velocity deciding unit 53, and a work implement control unit 54. As illustrated in FIGS. 5 and 6, the distance obtaining unit 51 obtains a distance d between the work implement 2 and the design plane 41. Specifically, the distance obtaining unit 51 calculates the distance d between the cutting edge P4 of the work implement 2 and the design plane 41 on the basis of the above-mentioned position information of the cutting edge P4 of the work implement 2 and the position information of the design plane 41.

The work aspect determining unit 52 determines the work aspect by the work implement 2. The work aspect determining unit 52 determines whether the work aspect by the work implement 2 is surface compaction work or not on the basis of the above-mentioned operation signals of the work implement 2. The surface compaction work is work for striking the ground surface with the floor surface (bottom surface) of the bucket 8 to harden the ground surface. The limit velocity deciding unit 53 limits the velocity of the work implement 2 as the distance d between the work implement 2 and the design plane 41 becomes smaller according to the velocity limit control.

The work implement control unit 54 controls the work implement 2 by outputting command signals to the above-mentioned control valve 27. The work implement control unit 54 decides the output values of the command signals to the control valve 27 in accordance with the operation amount of the work implement 2.

Figure 7:
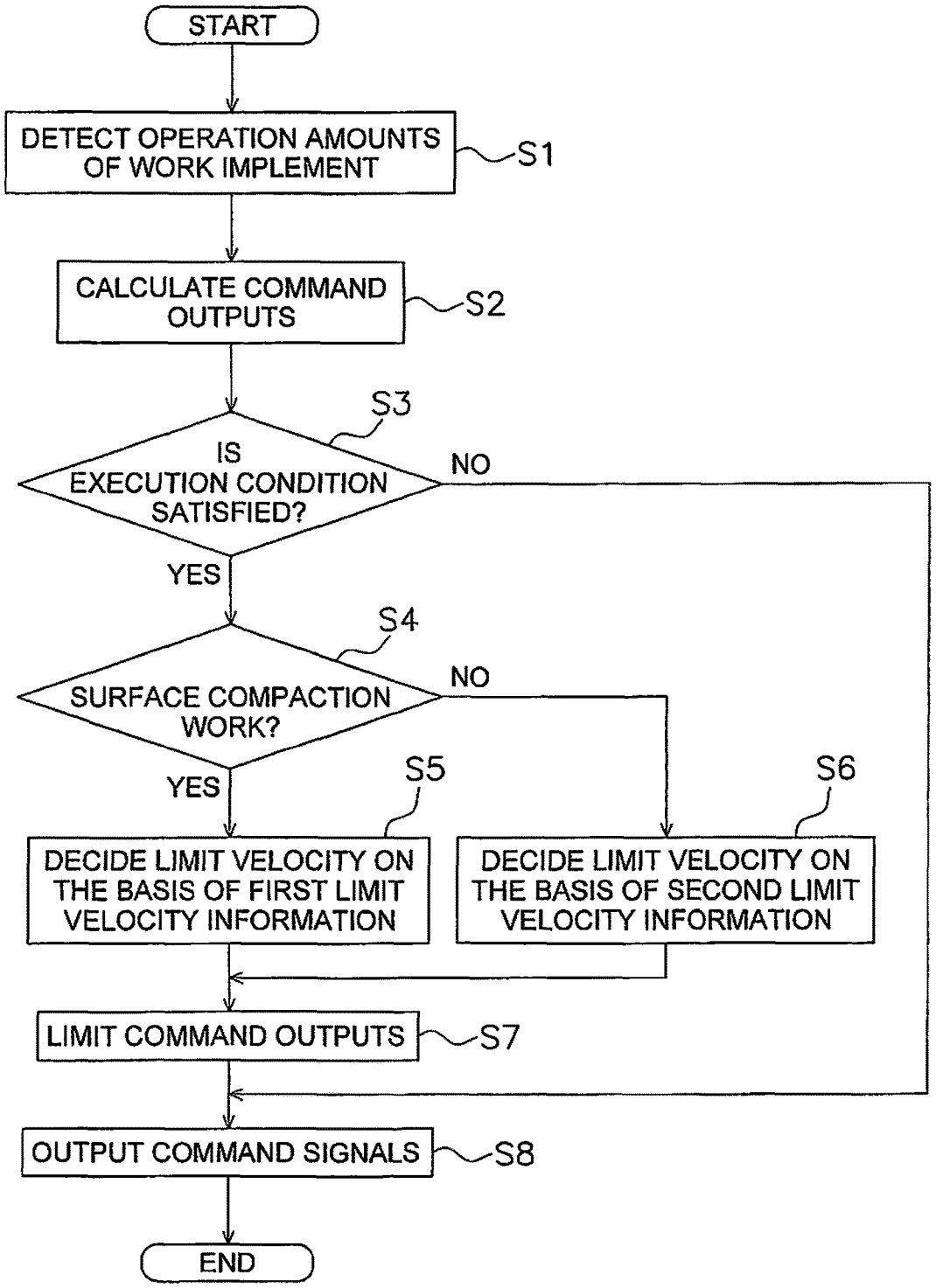
FIG. 7 is a flow chart of processing of a velocity limit control.

FIG. 7 is a flow chart illustrating a process of the velocity limit control. The operation amounts of the work implement 2 are detected in step S1 as illustrated in FIG. 7. Here, the above-mentioned boom operation amount, the bucket operation amount, and the arm operation amount are detected.

In step S2, the command outputs are calculated. Here, the output values of the command signals to the control valve 27 are calculated when the velocity is not being limited. The work implement control unit 54 calculates the output values of the command signals to the control valve 27 in accordance with the detected boom operation amount, the bucket operation amount, and the arm operation amount.

A determination is made in step S3 as to whether an execution condition for the velocity limit control is satisfied. Here, the work aspect determining unit 52 determines that the execution condition of the velocity limit control is satisfied on the basis of the boom operation amount, the bucket operation amount, and the arm operation amount. For example, the execution condition of the velocity limit control includes a boom operation and a bucket operation being performed but not an arm operation being performed. Moreover, the execution condition of the velocity limit control includes the distance between the cutting edge P4 of the work implement 2 and the design plane 41 and the velocity of the cutting edge P4 satisfying predetermined conditions.

Figure 8:
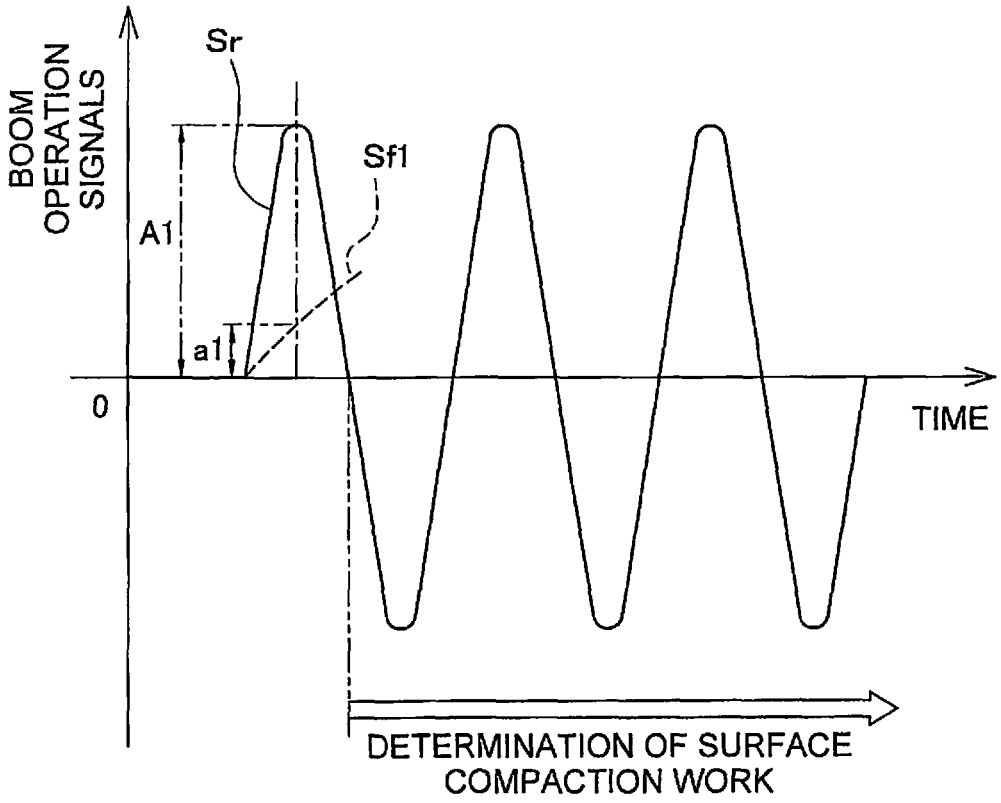
FIG. 8 illustrates an example of surface compaction work determination processing.

In step S4, a determination is made as to whether the work aspect is surface compaction work or not. Here, the work aspect determining unit 52 determines whether the work aspect is the surface compaction work on the basis of the boom operation amount. FIG. 8 illustrates an example of surface compaction work determination processing. The vertical axis in FIG. 8 indicates the boom operation signals from the first operating member 28. The horizontal axis indicates time. The values of the boom operation signals being positive indicate a lowering operation of the boom. The values of the boom operation signals being negative indicate a raising operation of the boom. The boom operation signal being zero indicates that the first operating member 28 is in the neutral position.

Sr in FIG. 8 indicates the actual boom operation signal. Sf1 indicates a boom operation signal subjected to a low-pass filter treatment. A1 is the actual operation signal from the boom operation. a1 is a value of the boom operation signal subjected to the low-pass filter treatment.

The work aspect determining unit 52 determines that the work aspect is the surface compaction work when the operating direction of the boom 6 is reversed after the equation a1/A1<r1 is satisfied. r1 is a constant less than one. While the case of the lowering operation of the boom 6 is depicted in FIG. 8, the raising operation of the boom 6 may also be determined in the same way. Moreover, while A1 is the peak value of the boom operation signal in FIG. 8, A1 may be a value other than the peak value.

When the work aspect is determined as the surface compaction work in step S4, the routine advances to step S5. In step S5, the limit velocity deciding unit 53 decides a limit velocity on the basis of the first limit velocity information. When the work aspect is determined as not being the surface compaction work in step S4, the routine advances to step S6. In step S6, the limit velocity deciding unit 53 decides a limit velocity on the basis of the second limit velocity information. The limit velocity is the upper limit of the velocity of the cutting edge P4 of the work implement 2 in the vertical direction toward the design plane 41.

Figure 9:
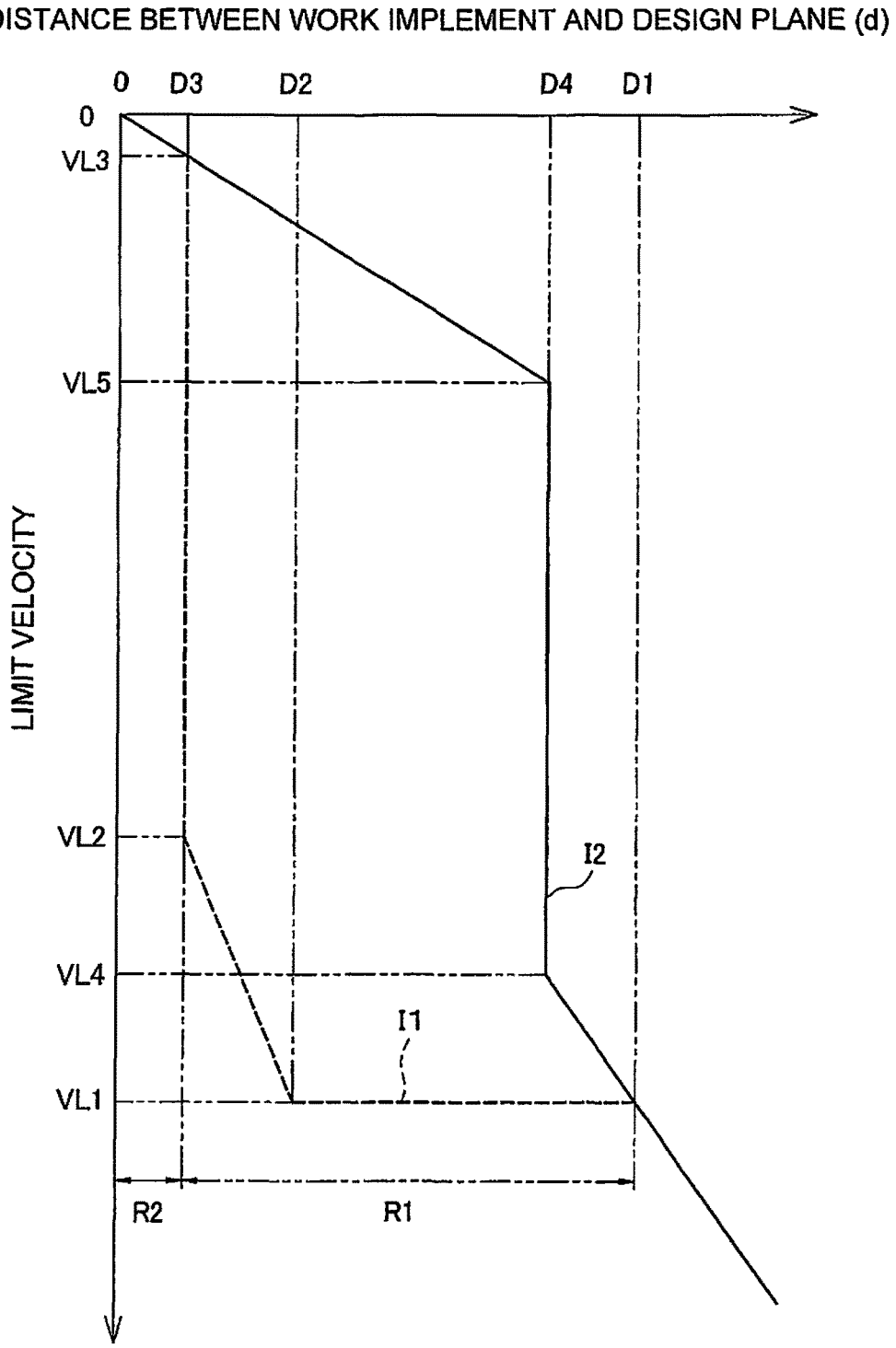
FIG. 9 illustrates first limit velocity information and second limit velocity information.

The limit velocity deciding unit 53 decides a first limit velocity on the basis of first limit velocity information 11 illustrated in FIG. 9. The first limit velocity information 11 defines the relationship between the distance d1 between the work implement 2 and the design plane 41 and the limit velocity when the work aspect is the surface compaction work. Second limit velocity information 12 defines the relationship between the distance d1 between the work implement 2 and the design plane 41 and the limit velocity when the work aspect is a work other than the surface compaction work. The first limit velocity information 11 and the second limit velocity information 12 are stored in the storage unit 38.

As illustrated in FIG. 9, when a distance d is greater than a predetermined first distance D1, the first limit velocity information 11 and the second limit velocity information 12 match. When the distance d is greater than the first distance D1, the limit velocity is reduced in correspondence to a reduction in the distance d according to either of the first limit velocity information 11 and the second limit velocity information 12 match.

When the distance d is within a first range R1, the limit velocity based on the first limit velocity information 11 is greater than the limit velocity based on the second limit velocity information 12. Therefore, the limit velocity during surface compaction work is greater than the limit velocity during work other than surface compaction while the distanced is within the first range R1.

Specifically, according to the first limit velocity information 11, when the distance d is within the range from the first distance D1 to a second distance D2 within the first range R1, the limit velocity is constant at a predetermined value VL1 even if the distance d becomes smaller. The second distance D2 is smaller than the first distance D1. That is, according to the first limit velocity information 11, when the distance d is within the range from the first distance D1 to the second distance D2, the limit velocity is not reduced even if the distance d becomes smaller. Therefore, the limit velocity deciding unit 53 makes the limit velocity constant even if the distance d becomes smaller when the work aspect is the surface compaction work and while the distance d is within the range from the first distance D1 to the second distance D2.

According to the first limit velocity information 11, when the distance d is within the range from the second distance D2 to a third distance D3 within the first range R1, the limit velocity becomes smaller as the distance d become smaller. The third distance D3 is smaller than the second distance D2. Specifically, when the distance d is within the range from the second distance D2 to the third distance D3, the limit velocity is reduced from VL1 to VL2 as the distance d becomes smaller. Therefore, the limit velocity deciding unit 53 reduces the limit velocity as the distance d becomes smaller when the work aspect is the surface compaction work and while the distance d is within the range from the first distance D2 to the second distance D3.

According to the first limit velocity information 11, the limit velocity rapidly becomes smaller when the distance d becomes the third distance D3. Specifically, the limit velocity is reduced rapidly from VL2 to VL3 when the distance d becomes the third distance D3. Therefore, the limit velocity deciding unit 53 reduces the limit velocity rapidly when the work aspect is the surface compaction work and when the distance d is reduced to the third distance D3.

According to the first limit velocity information 11, the limit velocity becomes smaller as the distance d becomes smaller when the distance d is within a second range R2. The second range R2 is a range from the third distance D3 to zero. Specifically, the limit velocity is reduced from VL3 to zero as the distance d becomes smaller when the distance d is within the second range R2. The limit velocity is zero when the distance is zero and the work aspect is the surface compaction work.

The first range R1 is wider than the second range R2. The second range R2 may be omitted. That is, the first range may be the range from the first distance D1 to zero.

According to the second limit velocity information 12, the limit velocity becomes smaller as the distance d becomes smaller when the distance d is greater than a fourth distance D4. The fourth distance D4 is smaller than the first distance D1 and larger than the second distance D2.

According to the second limit velocity information 12, the limit velocity rapidly becomes smaller when the distance d is the fourth distance D4. Specifically, according to the second limit velocity information 12, the limit velocity is reduced from VL4 to VL5 when the distance d is the fourth distance D4. The above-mentioned VL1 is greater than VL4. VL2 is less than VL4. VL5 is less than VL2. VL5 is greater than VL3.

According to the second limit velocity information 12, the limit velocity becomes smaller as the distance d becomes smaller when the distance d is smaller than the fourth distance D4. The reduction rate of the limit velocity with respect to the reduction in the distance d when the distance d is smaller than the fourth distance D4 according to the second limit velocity information 12, is the same as the reduction rate of the limit velocity with respect to the reduction in the distance d when the distance d is within the second range R2 according to the first limit velocity information 11. That is, the first limit velocity information 11 and the second limit velocity information 12 match when the distance d is within the second range R2. Therefore, the limit velocity during surface compaction work is the same as the limit velocity during work other than surface compaction while the distance d is within the second range R2.

As described above, the limit velocity deciding unit 53 reduces the limit velocity of the work vehicle 100 toward the design plane 41 in correspondence to a reduction in the distance d between the work implement 2 and the design plane 41 in the velocity limit control. However, the limit velocity during surface compaction work is greater than the limit velocity during work other than surface compaction while the distance d is within the first range R1.

In step S7, the work implement control unit 54 limits the command outputs. Here, the work implement control unit 54 decides the command outputs to the control valve 27 so that the velocity of the work implement 2 does not exceed the limit velocity decided in step S5 or step S6.

Specifically, a vertical velocity component of an estimated velocity of the work implement 2 is calculated on the basis of the boom operation amount and the bucket operation amount. The vertical velocity component is the velocity of the cutting edge P4 of the work implement 2 in the vertical direction of the design plane 41. When the vertical velocity component of the estimated velocity is greater than the limit velocity, a ratio of the limit velocity with respect to the vertical velocity component of the estimated velocity is calculated. A value derived by multiplying the estimated velocity of the boom cylinder 10 based on the boom operation amount by the ratio is decided as a target velocity of the boom cylinder 10. Similarly, the value derived by multiplying the estimated velocity of the bucket cylinder 12 based on the bucket operation amount by the ratio is decided as the target velocity of the bucket cylinder 12. The command outputs to the control valve 26 are decided so that the boom cylinder 10 and the bucket cylinder 12 operate at the target velocities.

When only the boom 6 is operated, only the target velocity of the boom 6 is decided. When only the bucket 8 is operated, only the target velocity of the bucket 8 is decided.

In step S8, the command signals are outputted. Here, the work implement control unit 54 outputs the command signals decided in step S7 to the control valve 27. As a result, the work implement control unit 54 controls the work implement 2 so that the velocity of the work implement 2 becomes smaller as the distance d between the design plane 41 and the work implement 2 becomes smaller in the velocity limit control. Moreover, the work implement control unit 54 controls the work implement 2 so that the velocity of the work implement 2 becomes larger in comparison to when the work aspect is a work other than surface compaction when the work aspect is the surface compaction work and the distance d is within the first range R1.

In step S3, a determination is made that the execution condition for the velocity limit control is not satisfied when the arm operation is being performed. When the execution condition of the velocity limit control is not satisfied, the above-mentioned velocity limit control is not performed and the command signals are outputted in step S8. That is, the command signals decided in response to the boom operation amount, the bucket operation amount, and the arm operation amount in step S2 are outputted to the control valve 27. The processing from step S1 to step S8 is repeated during the operation of the work vehicle 100.

Figure 10:
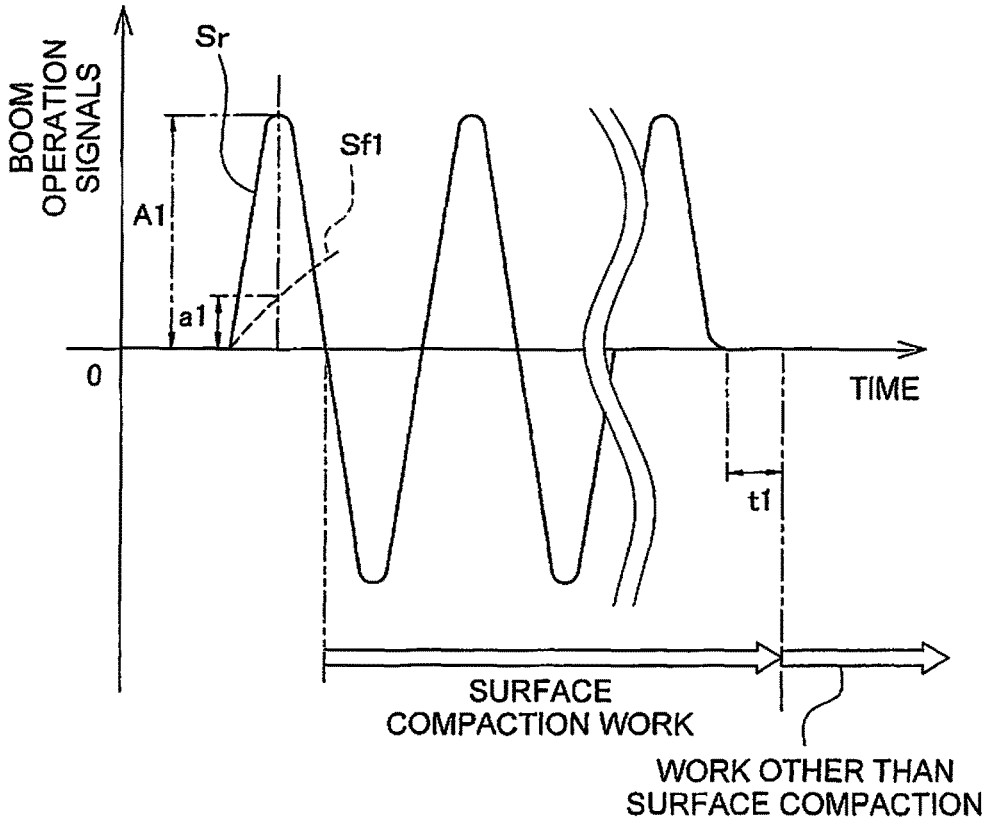
FIG. 10 illustrates an example of determination processing of the completion of surface compaction work.

As illustrated in FIG. 10, the work aspect determining unit 52 determines that the surface compaction work is finished and the work aspect has been changed to a work other than surface compaction when the state of the first operating member 28 being in the neutral position is continued for a predetermined first determination time t1.

Figure 11:
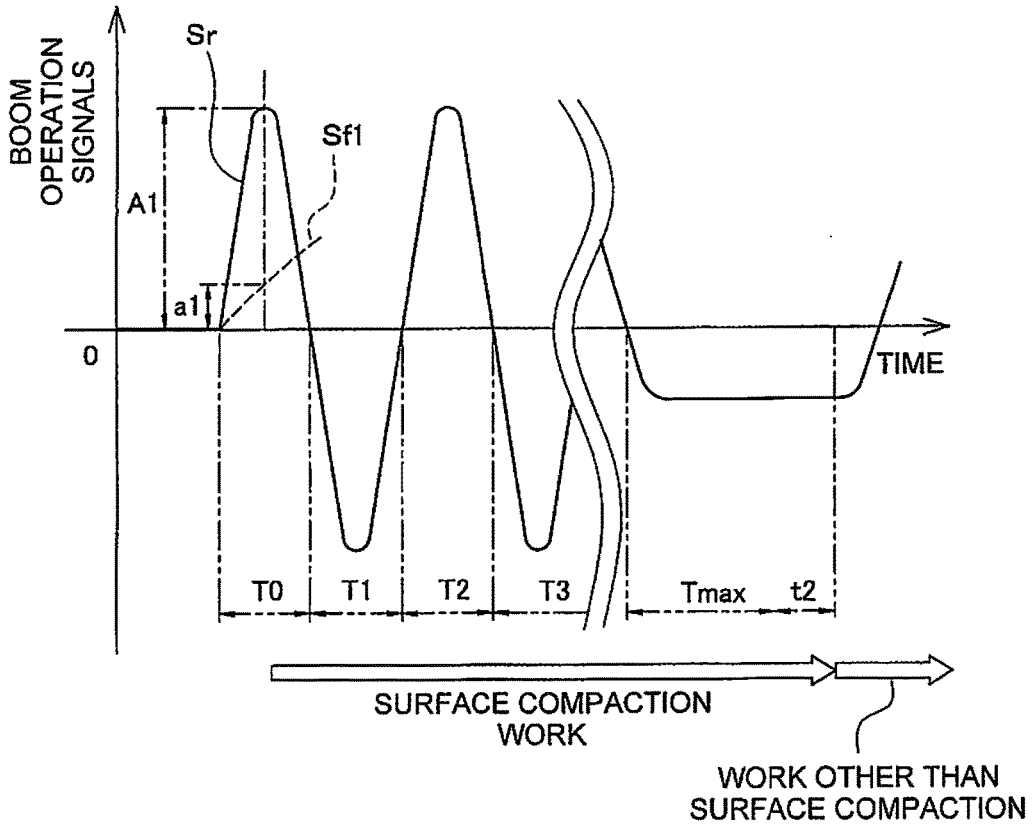
FIG. 11 illustrates an example of determination processing of the completion of surface compaction work.

Moreover, as illustrated in FIG. 11, the work aspect determining unit 52 determines that the surface compaction work is finished and the work aspect has been changed to work other than surface compaction when the state of the first operating member 28 being operated in the same direction is continued for a predetermined second determination time Tmax+t2. "Tmax" is the maximum value of the continuation times T0, T1, T2, T3, . . . of the state of the first operating member 28 being operated in the same direction. "t2" is a predetermined constant.

The velocity of the work implement 2 is limited in correspondence to a reduction in the distance d between the work implement 2 and the design plane 41 in the control system of the work vehicle 100 according to the present exemplary embodiment described above. As a result, the work implement 2 exceeding the design plane 41 and excavating during excavation can be suppressed. Moreover, when the work aspect is surface compaction work and the distance d between the work implement 2 and the design plane 41 is within the first range R1, the limit velocity of the work implement 2 is increased in comparison to when the work aspect is an aspect of a work other than surface compaction. As a result, the work implement 2 is enabled to strike the ground during surface compaction work at a velocity greater than that during excavation work. As a result, the surface compaction work can be carried out in a favorable manner. Moreover, because the velocity of the work implement 2 is controlled so that the velocity becomes a limit velocity in accordance with the distance d, the strength of the surface compaction by the work implement 2 can be made substantially constant. Consequently, variation in surface compaction can be reduced.

The limit velocity is constant when the work aspect is the surface compaction work and while the distance d between the work implement 2 and the design plane 41 is within the range from the first distance D1 to the second distance D2. As a result, the velocity of the work implement 2 can be set so as not to be substantially limited while the distance d is within the range from the first distance D1 to the second distance D2.

The limit velocity deciding unit 53 reduces the limit velocity as the distance d becomes smaller when the work aspect is the surface compaction work and while the distance d from the work implement 2 to the design plane 41 is within the range from the first distance D2 to the third distance D3. As a result, the velocity of the work implement 2 can be limited while the work implement 2 moves closer to the ground surface than the second distance D2. As a result, the work implement striking the ground surface with an excessively large velocity can be suppressed and excessive impacts can be suppressed.

The limit velocity during surface compaction work is the same as the limit velocity during work other than surface compaction while the distance d between the work implement 2 and the design plane 41 is within the second range R2. As a result, the work implement 2 can be operated in the same way as when carrying out a work other than surface compaction when the work implement 2 is in the proximity of the ground surface even when the work is determined as still being surface compaction work after the surface compaction is finished. As a result, the cutting edge P4, for example, can be operated easily to conform to the design plane 41.

The limit velocity is zero when the distance d between the work implement 2 and the design plane 41 is zero and the work aspect is the surface compaction work. As a result, the work implement 2 moving to a position greatly exceeding the design plane 41 during surface compaction work can be suppressed.

The following is a discussion of the control system 300 of the work vehicle 100 according to a second exemplary embodiment. The work aspect determining unit 52 determines whether a leveling determination condition is satisfied in the control system 300 of the work vehicle 100 according to the second exemplary embodiment. The leveling determination condition is a condition indicating that the work carried out by the work implement 2 is leveling work. The leveling determination condition includes, for example, the operation being an arm operation. Moreover, the leveling determination condition includes the distance between the cutting edge P4 and the design plane 41 and the velocity of the cutting edge P4 being within standard values.

The limit velocity deciding unit 53 decides to execute a leveling control when the leveling determination condition is satisfied. The limit velocity deciding unit 53 controls the work implement 2 so that the work implement 2 moves along the design plane 41 in the leveling control.

Figure 12:
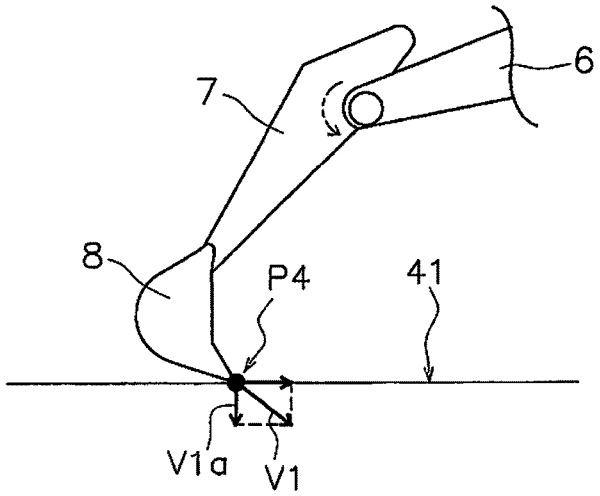
FIG. 12 illustrates velocity control of the work implement during leveling control.

Specifically, as illustrated in FIG. 12, the limit velocity deciding unit 53 calculates a vertical speed component V1*a* that is vertical with respect to the design plane 41 from the velocity V1 of the cutting edge P4 when the cutting edge P4 moves in a direction approaching the design plane 41. The limit velocity deciding unit 53 then decides a velocity for raising the boom 6 so that the vertical velocity component V1*a* is canceled out.

The limit velocity deciding unit 53 executes a normal velocity limit control when the above-mentioned execution condition of the velocity limit control is satisfied but a determination is made that the work aspect is not the surface compaction work. The normal velocity limit control is the control for limiting the velocity of the cutting edge P4 on the basis of the second limit velocity information 12 described above in the first exemplary embodiment.

The limit velocity deciding unit 53 executes a surface compaction control when it is determined that the work aspect is the surface compaction work. The surface compaction control is the control for limiting the velocity of the cutting edge P4 on the basis of the first limit velocity information 11 described above in the first exemplary embodiment. The limit velocity deciding unit 53 executes the surface compaction control when it is determined that the work aspect is the surface compaction work even when the execution condition of the above-mentioned velocity limit control is not satisfied. For example, the limit velocity deciding unit 53 executes the surface compaction control when it is determined that the work aspect is the surface compaction work even when an arm operation is being carried out. Further, the limit velocity deciding unit 53 maintains the surface compaction control when the leveling work condition is satisfied while the surface compaction control is being carried out.

In the control system 300 of the work vehicle 100 according to the second exemplary embodiment, the leveling control is executed when the leveling determination condition is satisfied and it is determined that the work aspect is not the surface compaction work. Moreover, the surface compaction control is executed when it is determined that the work aspect is the surface compaction work. As a result, the leveling work and the surface compaction work can be carried out in a favorable manner.

Moreover, the surface compaction control is executed when the work aspect is the surface compaction work even if the leveling determination condition is satisfied. That is, the surface compaction control takes precedence over the leveling control. Therefore, the surface compaction work is maintained even if the leveling control condition is satisfied while the surface compaction control is being executed. As a result, a case in which the leveling control is executed by mistake can be suppressed even when an operation that can be easily confused with an operation during leveling work is carried out during surface compaction work. Moreover, the leveling control is canceled and the surface compaction control is executed when it is determined that the work aspect is the surface compaction work while the leveling control is being executed. As a result, the surface compaction work can be carried out promptly after the leveling work.

Although exemplary embodiments of the present invention have been described so far, the present invention is not limited to the above exemplary embodiments and various modifications may be made within the scope of the invention.

The work vehicle 100 is not limited to a hydraulic excavator and may be any work vehicle having a bucket such as a backhoe loader and the like. Moreover, a crawler-type hydraulic excavator and a wheel-type hydraulic excavator are included as the hydraulic excavator.

The work vehicle 100 may be remotely operated. That is, the controller 26 may be divided into a remote controller disposed outside of the work vehicle 100 and an on-board controller disposed inside the work vehicle 100, and the two controllers may be configured to allow communication therebetween.

Figure 13:
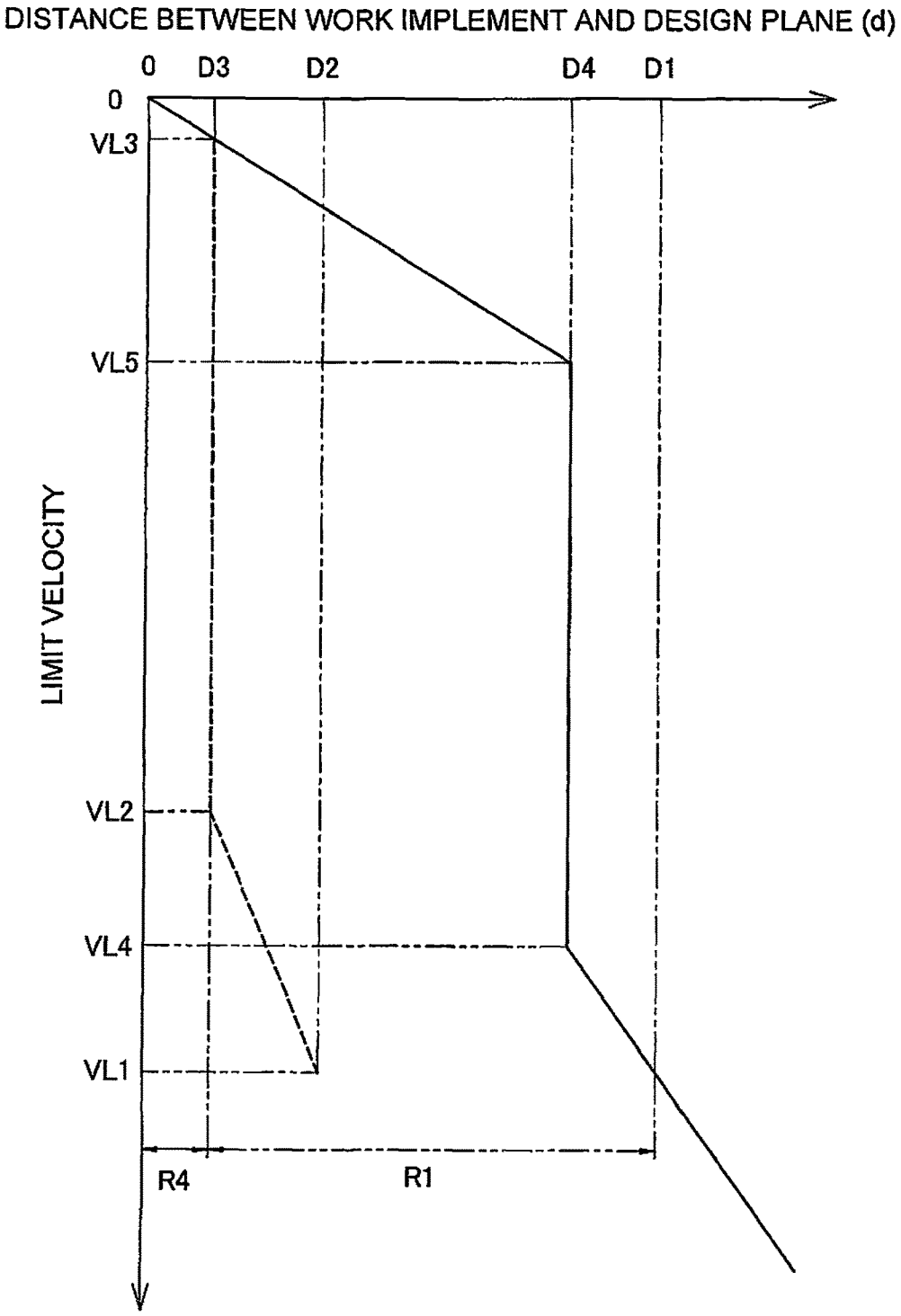
FIG. 13 illustrates first limit velocity information and second limit velocity information according to another exemplary embodiment.

The limit velocity deciding unit 53 may cancel the limiting of the velocity of the work implement 2 when the work aspect is the surface compaction work and the distance d between the work implement 2 and the design plane 41 is at least within the predetermined first range R1. For example as illustrated in FIG. 13, the limiting of the velocity of the work implement 2 may be canceled when the abovementioned distance d is within the range from the first distance D1 to the second distance D2.

The properties of the first limit velocity information 11 are not limited to those in the above exemplary embodiments and may be changed. The properties of the second limit velocity information 12 are not limited to those in the above exemplary embodiments and may be changed.

The limit velocity is not limited to zero and may be greater than zero when the distance d between the work implement 2 and the design plane 41 is zero and the work aspect is the surface compaction work.

The method for determining whether the work aspect is the surface compaction work is not limited to the method described in the above exemplary embodiments and may be changed. For example, the work aspect determining unit 52 may determine that the work aspect is the surface compaction work when the equation a1/A1<r1 is satisfied.

The method for determining the position of the cutting edge P4 of the work implement 2 is not limited to the method described in the above exemplary embodiments and may be changed. For example, the position detecting unit 36 may be disposed on the cutting edge P4 of the work implement 2.

The method for detecting the distance d between the work implement 2 and the design plane 41 is not limited to the method described in the above exemplary embodiments and may be modified. For example, the distance d between the work implement 2 and the design plane 41 may be detected by an optical, an ultrasonic, or a laser beam-type distance measuring device.

While the distance obtaining unit 51 calculates the distance d1 between the cutting edge P4 of the work implement 2 and the design plane 41 in the above exemplary embodiments, the present invention is not limited in this way. The distance obtaining unit 51 may obtain the distance d1 between the work implement and the design terrain on the basis of position information of contour points of the bucket including the cutting edge P4, and the position information of the design plane 41. In this case, the distance between the design plane and the contour point representing the smallest distance to the design plane among the contour points of the bucket may be used as the distance between the work implement and the design terrain.

According to the present invention, surface compaction work can be carried out in a favorable manner by a work vehicle.

What is claimed is:

1. A control system for a work vehicle including a work implement, the control system comprising:

an operating device configured to receive operations from an operator for driving the work implement and to output an operation signal in accordance with an operation amount of the operating device; and a controller programmed to control the work implement based on the operation signal, the controller including a storage unit for storing construction information defining a design terrain which represents a target shape of a work object;

a distance obtaining unit for obtaining a distance between the work implement and the design terrain;

a work aspect determining unit for determining whether or not a work aspect by the work implement is a surface compaction work based on the operation signal; and a limit velocity deciding unit that executes a normal velocity limit control for limiting a velocity of the work implement to a limit velocity when the distance is equal to or smaller than a first distance and the work aspect is not the surface compaction work, the limit velocity deciding unit executing a surface compaction control instead of the normal velocity limit control when the work aspect is the surface compaction work and the distance is within a first range, a largest distance of the first range being the first distance, the surface compaction control being executed such that the limit velocity of the work implement is larger than during the normal velocity control within the first range.

2. The control system for the work vehicle according to claim 1, wherein when the surface compaction control is executed while the distance is within a range from the first distance to a second distance smaller than the first distance, the limit velocity deciding unit makes the limit velocity constant with respect to the distance.

3. The control system for the work vehicle according to claim 2, wherein when the surface compaction control is executed while the distance is within a range from the second distance to a third distance smaller than the second distance, the limit velocity deciding unit reduces the limit velocity in correspondence to a reduction in the distance.

4. The control system for the work vehicle according to claim 1, wherein when the distance is within a second range of distances spanning from a lower limit of the first range to zero, the limit velocity during the surface compaction control is the same as the limit velocity during the normal velocity limit control.

5. The control system for the work vehicle according to claim 4, wherein the first range is wider than the second range.

6. The control system for the work vehicle according to claim 1, wherein when the distance is zero and the work aspect is the surface compaction work, the limit velocity is zero.

7. The control system for the work vehicle according to claim 1, wherein the work aspect determining unit determines that the work aspect is the surface compaction work when a determination condition of the surface compaction work is satisfied, the determination condition including a condition in which a ratio is smaller than a predetermined threshold, the ratio being calculated by subjecting the operation amount of the operating device to a low-pass filter treatment and dividing a result of the low-pass filter treatment by the operation amount of the operating device.

8. The control system for the work vehicle according to claim 1, wherein the storage unit stores a first limit velocity information which represents a relationship between the distance and the limit velocity when the work aspect is the surface compaction work, and a second limit velocity information which represents a relationship between the distance and the limit velocity when the work aspect is not the surface compaction work, and the limit velocity deciding unit decides the limit velocity on the basis of the first limit velocity information when the work aspect is the surface compaction work, the limit velocity deciding unit decides the limit velocity on the basis of the second limit velocity information when the work aspect is not the surface compaction work, and the limit velocity when the distance is within the first range according to the first limit velocity information is greater than the limit velocity when the distance is within the first range according to the second limit velocity information.

9. The control system for the work vehicle according to claim 1, wherein the work aspect determining unit is further configured to determine whether a leveling determination condition for determining that the work by the work implement is leveling work is satisfied, the limit velocity deciding unit decides to execute a leveling control for controlling the work implement so that the work implement moves along the design terrain when the leveling determination condition is satisfied, and the limit velocity deciding unit maintains the surface compaction control when the leveling determination condition is satisfied while the surface compaction control is being executed.

10. A control method for a work vehicle including a work implement and a controller, the method comprising using the controller to execute:

a step for obtaining distance information which indicates a distance between the work implement and a design terrain which represents a target shape of a work object;

a step of receiving an operation signal in accordance with an operation amount of an operating device;

a step for determining whether a work aspect by the work implement is a surface compaction work based on the operation signal;

a step for outputting a command signal to limit a velocity of the work implement to a normal limit velocity in response to a reduction in the distance when the distance is smaller than a first distance and the work aspect is not the surface compaction work; and a step for outputting the command signal to limit the velocity of the work implement to a limit velocity larger than the normal limit velocity when the work aspect is the surface compaction work and the distance is within a predetermined first range, a largest distance of the first range being the first distance.

11. A work vehicle comprising:

a work implement;

an operating device configured to receive operations from an operator for driving the work implement and to output an operation signal in accordance with an operation amount of the operating device; and a work implement control unit for controlling the work implement, the work implement control unit determining whether or not a work aspect by the work implement is a surface compaction work based on the operation signal, executing a normal velocity limit control of the work implement so that a velocity of the work implement becomes smaller as a distance between the work implement and a design terrain which represents a target shape of a work object becomes smaller when the distance is equal to or smaller than a first distance and a work aspect of the work implement is not the surface compaction work, and executing a surface compaction control of the work implement so that the velocity of the work implement increases in comparison to the normal velocity limit control when the work aspect is the surface compaction work and the distance is within a first range, a largest distance of the first range being the first distance.

* * * * *